US006481561B2

(12) United States Patent
Yamamoto et al.

(10) Patent No.: US 6,481,561 B2
(45) Date of Patent: Nov. 19, 2002

(54) CONTAINER FEEDER

(75) Inventors: Hidekimi Yamamoto, Tokushima (JP); Hiroshi Katayama, Tokushima (JP); Masafumi Fujimoto, Tokushima (JP); Kiyomi Yoshida, Tokushima (JP); Michio Ueda, Tokushima (JP)

(73) Assignee: Shikoku Kakoki Co., Ltd., Itano-gun (JP)

( * ) Notice: Subject to any disclaimer, the term of this patent is extended or adjusted under 35 U.S.C. 154(b) by 19 days.

(21) Appl. No.: 09/833,589

(22) Filed: Apr. 13, 2001

(65) Prior Publication Data

US 2001/0030106 A1 Oct. 18, 2001

(30) Foreign Application Priority Data

Apr. 14, 2000 (JP) ..... 2000-112888

(51) Int. Cl.[7] ..... B65G 47/31
(52) U.S. Cl. ..... 198/461.1; 198/462.3
(58) Field of Search ..... 198/462.3, 461.1

(56) References Cited

U.S. PATENT DOCUMENTS 5,031,380 A * 7/1991 Ueda ..... 156/272.4
5,836,143 A * 11/1998 Yoshida et al. ..... 198/832
5,852,919 A * 12/1998 Matsuda et al. ..... 53/202
6,079,188 A * 6/2000 Katayama et al. ..... 53/389.2

FOREIGN PATENT DOCUMENTS

JP 10-29608 2/1998

* cited by examiner

*Primary Examiner*—Christiopher P. Ellis
*Assistant Examiner*—Richard Ridley
(74) *Attorney, Agent, or Firm*—Armstrong, Westerman & Hattori, LLP

(57) ABSTRACT

A container feeder for feeding pillowlike uncompleted containers C1 each having a container body M1 and upper and lower ears U1, L1 projecting laterally from upper and lower ends of the container body to a conveyor 21 of a container forming device 14 for forming the uncompleted container C1 into a rectangular parallelepipedal completed container C2 comprises a slanting chute 101 having a lower end positioned at a starting end of a conveyor transport path, a first receiving member 134 so disposed as to be movable upward or downward along a chute transport path, the first receiving member 134 being movable into the chute transport path when moving downward to receive the lower end of the container body M1 of the container C1 falling along the chute 101 under gravity, and a second receiving member 144 so disposed as to be movable upward or downward along the chute transport path, the second receiving member 144 being movable into the chute transport path when moving downward to receive the upper ears U1 of the container C1 received by the first receiving member 134.

6 Claims, 8 Drawing Sheets

CONTAINER FEEDER

BACKGROUND OF THE INVENTION

The present invention relates to packaging machines, and more particularly to a container feeder for use in packaging machines for making a web of packaging material into a tube, filling contents into the tube, transporting the tube a distance at a time which distance corresponds to the length of one container, sealing and cutting the tube transversely thereof to form a pillowlike uncompleted container, and feeding the uncompleted container to a completed container forming device to form the container into a rectangular parallelepipedal completed container, the container feeder being adapted to feed the uncompleted container to the completed container forming device.

As disclosed, for example, in JP-A No. 10-29608 (1998), such feeders are already known for feeding pillowlike uncompleted containers to a conveyor of a container forming device for forming the uncompleted container into a rectangular parallelepipedal completed container. The known container feeder comprises a slanting chute having a lower end positioned at the starting end of the transport path of the conveyor, and a receiving member so disposed as to be movable upward or downward along the transport path of the chute, the receiving member being movable into the chute transport path when moving downward to receive the lower end of the container.

With the conventional feeder, the container is transported, as received by the receiving member at is lower end, along the chute. To avoid interference with the conveyor, the receiving member can not be moved down to a position close to the conveyor transport path. The container is eventually allowed to fall off the chute and received by the conveyor. Accordingly, the falling container becomes inevitably damaged by an impact produced when received by the conveyor.

SUMMARY OF THE INVENTION

An object of the present invention is to overcome the above problem and to provide a container feeder adapted to feed pillowlike uncompleted containers to a container forming device for forming the uncompleted container into a rectangular parallelepipedal completed container, without causing damage to the container during feeding.

The present invention provides a container feeder for feeding pillowlike uncompleted containers each having a container body and upper and lower ears projecting laterally from upper and lower ends of the container body to a conveyor of a container forming device for forming the uncompleted container into a rectangular parallelepipedal completed container, the container feeder comprising a slanting chute having a lower end positioned at a starting end of a conveyor transport path, a first receiving member so disposed as to be movable upward or downward along a chute transport path, the first receiving member being movable into the chute transport path when moving downward to receive the lower end of the container body of the container falling along the chute under gravity, and a second receiving member so disposed as to be movable upward or downward along the chute transport path, the second receiving member being movable into the chute transport path when moving downward to receive the upper ears of the container received by the first receiving member.

With the container feeder of the present invention, the container is transported along the chute while being received by the first receiving member first, and then by the second receiving member. Since the second receiving member receives the upper ears of the container, the second receiving member can be moved down to a position close to the conveyor transport path. Accordingly, the pillowlike uncompleted container can be fed to the container forming device free of damage. Since the container falling down the chute has its body received by the first receiving member, the container which is forced down can be received effectively, and can be delivered to the second receiving member after the container is relieved of the downward force.

If the path of upward or downward movement of the second receiving member has a lower end joined to the starting end of the conveyor transport path, the container can be received by the conveyor without allowing the container to fall off the chute.

Further if the speed of downward movement of the first receiving member is higher than the speed of downward movement of the second receiving member, the first receiving member rapidly leaves the container after the second receiving member receives the upper ears, with the result that the timing of delivery of the container from one receiving member to the other can be determined easily. Moreover, the container can then be fed to the container forming device smoothly free of damage.

The first receiving member is attached to a first endless chain having a lower-side travel path positioned close to the chute transport path along the upper side thereof, and the second receiving member is attached to a second endless chain having an upper-side travel path positioned close to the chute transport path along the lower side thereof, the second endless chain comprising a pair of chain members extending in parallel as spaced apart from each other by a predetermined distance and each having the second receiving member attached thereto, the chain members having lower ends positioned at opposite sides of the starting end of the conveyor transport path. In this case, the second receiving member can be moved down to the starting end of the conveyor transport path to deliver the container to the conveyor without the likelihood of the container falling off the chute.

The conveyor has holders, each holder comprising a bottom plate extending in parallel to the conveyor transport path, and a side plate projecting upward from the bottom plate and extending orthogonal to the conveyor transport path, the side plate of the holder as halted at the starting end of the conveyor transport path having an upper end joined to the lower end of the chute to deliver the container from the chute to the holder in this state. The container can then be allowed to slide down the chute and subsequently down the side plate for transport. Thus, the container can be fed to the container forming device free of any impact.

DESCRIPTION OF THE PREFERRED EMBODIMENT

An embodiment of the present invention will be described next with reference to the drawings.

Figure 1:
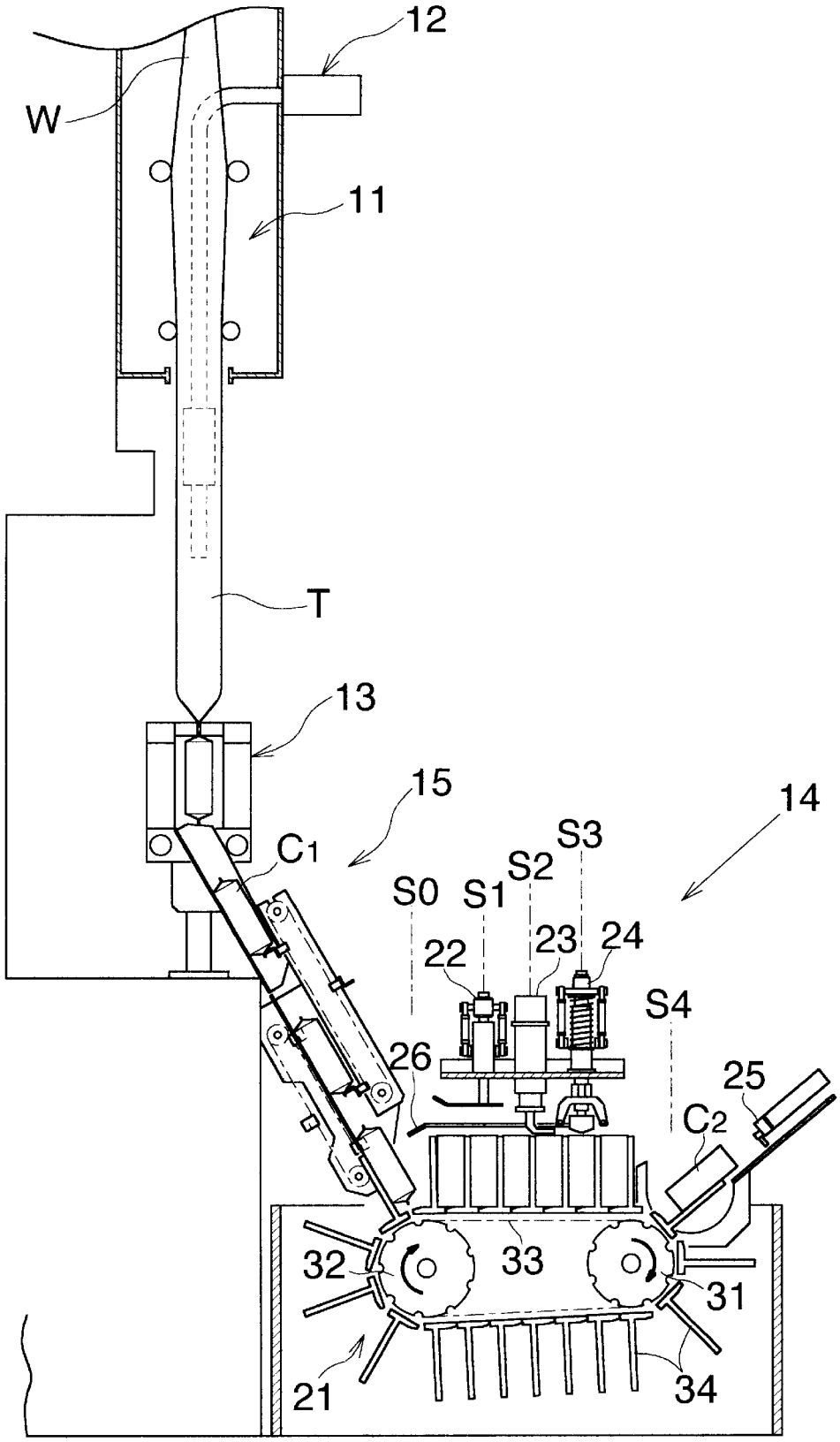
FIG. 1 is a fragmentary side elevation of a packaging machine including a container feeder of the invention.

FIG. 1 shows a packaging machine, which comprises a tube forming device 11 for forming a tube T from a web W of paper-base laminate having a thermoplastic resin layer over each of its opposite surfaces by lapping opposite edges of the laminate over each other and sealing the lap, a filling device 12 for filling the tube T with contents, an uncompleted container forming device 13 for forming pillowlike uncompleted containers C1 from the filled tube T by sealing and cutting the tube T transversely thereof while forwarding the filled tube T a distance at a time which distance corresponds to the length of one container, a completed container forming device 14 for forming the uncompleted container C1 into a rectangular parallelepipedal completed container C2, and a container feeder 15 for feeding uncompleted containers C1 to the completed container forming device 14.

Figure 8:
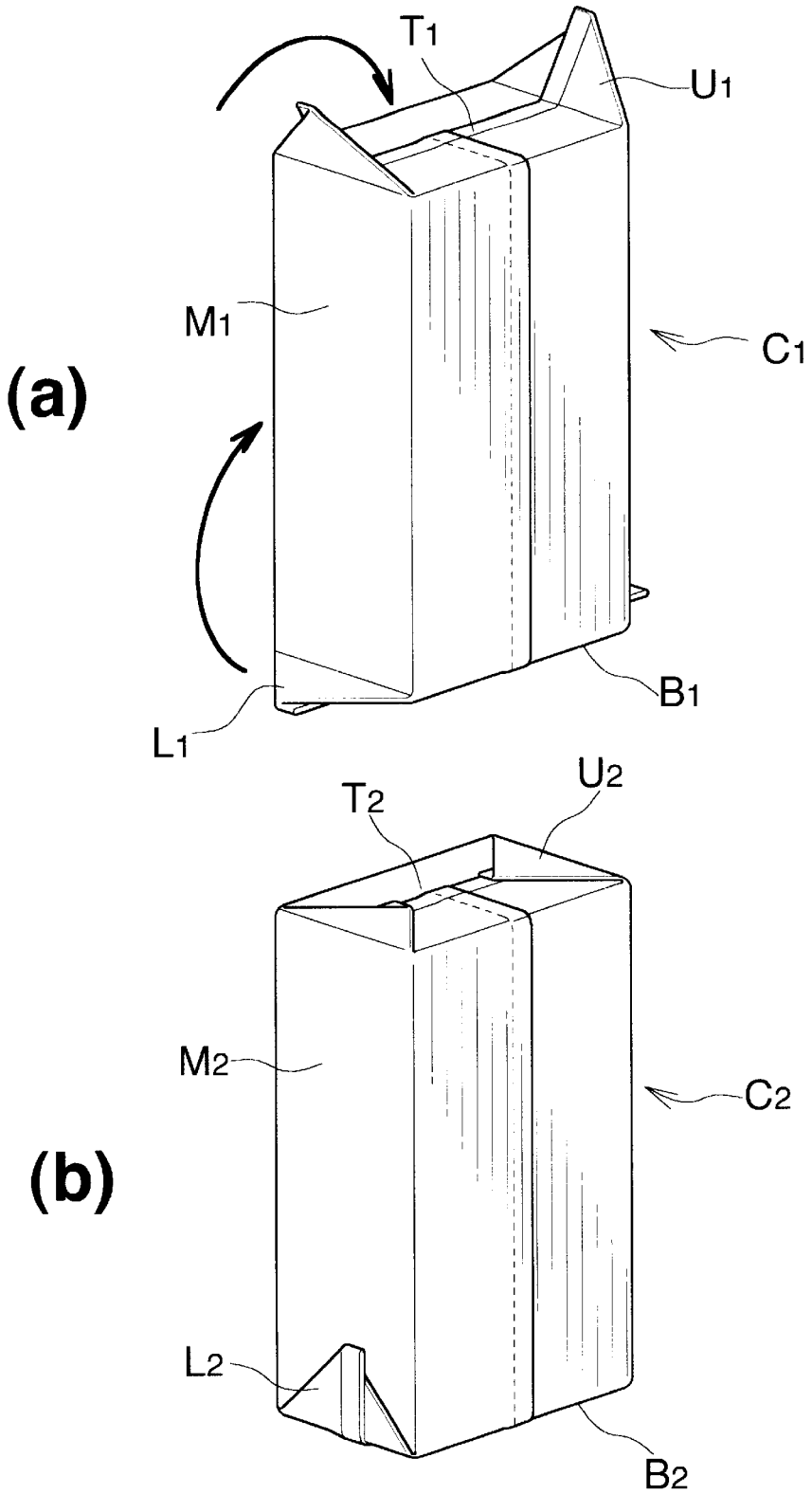
FIG. 8 includes perspective views of containers.

As shown in detail in FIG. 8(*a*), the uncompleted container C1 comprises a container body M1 having a top portion T1 and a bottom portion B1 which are V-shaped in cross section, and a pair of upper ears U1 and a pair of lower ears L1 projecting laterally from upper and lower ends although formed in a generally rectangular parallelepipedal shape.

As shown in FIG. 8(*b*), the completed container C2 comprises a container body M2 having a complete rectangular parallelepipedal shape and flat top portion T2 and bottom portion B2, a pair of upper ears U2 lapped over and bonded to the top portion T2, and a pair of lower ears L2 lapped over and bonded to respective side walls of the container body M2.

With reference to FIG. 1 again, the completed container forming device 14 is provided with a forming conveyor 21 disposed forwardly of the uncompleted container forming device 13 obliquely therebelow and having a path of transport extending forward via a feed station S0, folding station S1, heating station S2, ear bonding station S3 and discharge station S4.

The folding station S1 is provided with a folding device 22 for the uncompleted container C1 for folding the top portion T1 and bottom portion B1 of the uncompleted container C1 flat and folding the upper and lower ears U1, L1 upward to cause the upper ears U1 to project upward from the top folded portions and to position the lower ears L1 close to the respective side walls of the container body M1. The heating station S2 is provided with a heater 23 for heating the portions of the container body M1 and the ears U1, L1 to be bonded under pressure, the ear bonding station S3 is provided with an ear bonding device 24 for bonding under pressure the upper ears U1 to the top portion T1 in an overlapping manner and pressure-bonding the lower ears L1 to the side walls of the container body M1 in an overlapping manner, and the discharge station S4 is provided with a discharge device 25 for discharging the completed container C2 from the conveyor 21.

Folding guides 26 extend from the folding station S1 to the ear bonding station S3 via the heating station S2. While the container C1 is being transported from the folding station S1 to the ear bonding station S3, the upwardly projecting upper ears U1 are progressively folded downward to lap over the container body top portion T1 by the folding guides 26. Although not shown, similar folding guide are provided also for the lower ears L1.

The forming conveyor 21 comprises a front drive sprocket 31, a rear driven sprocket 32, an endless block chain 33 reeved around these sprockets 31, 32, and a multiplicity of holders 34 connected to the chain 33, each pair of adjacent holders 34 being in contact with each other.

Figure 5:
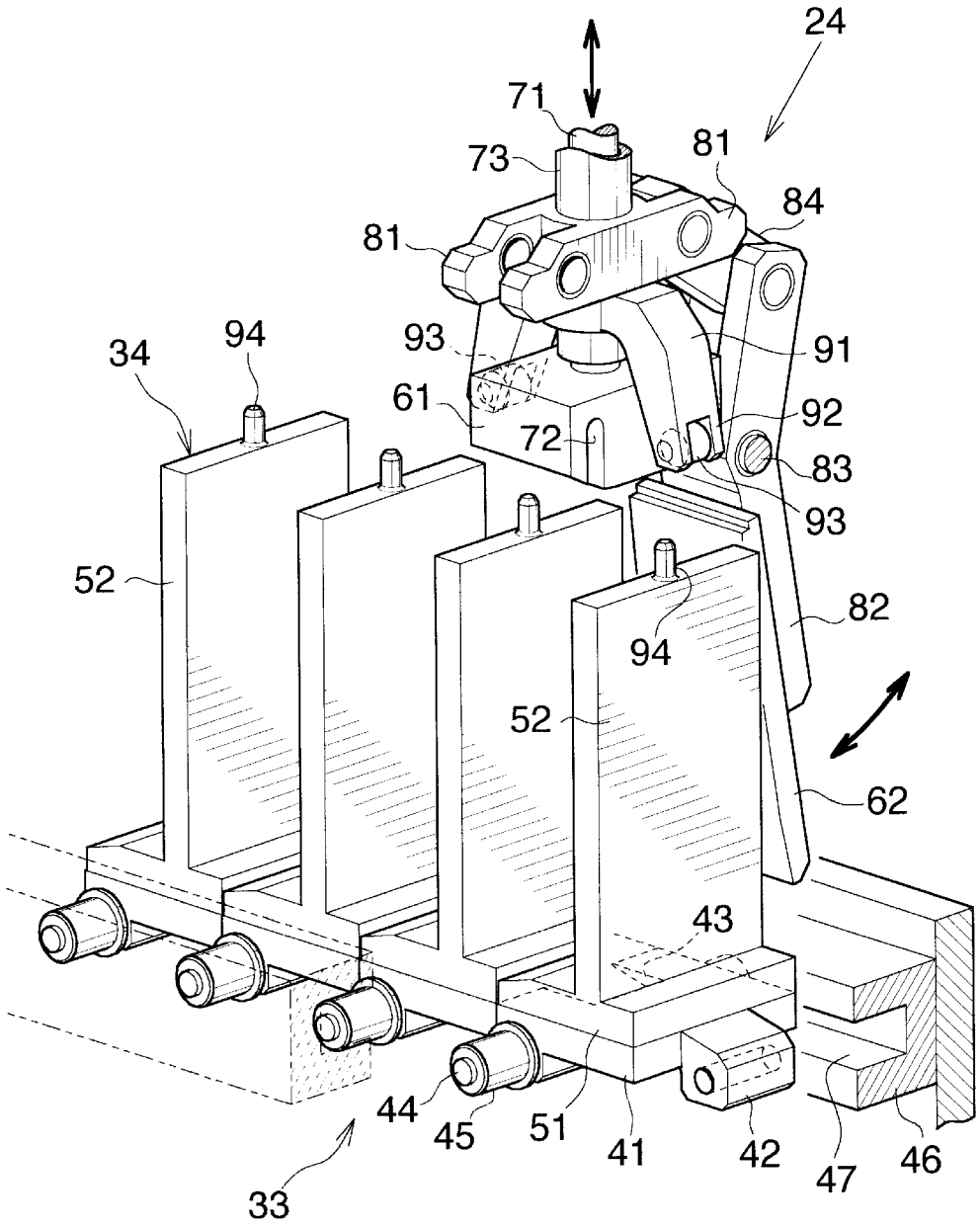
FIG. 5 is a perspective view showing an ear bonding device included in the packaging machine and the vicinity of the device.

As shown in FIG. 5 in detail, the chain 33 has a multiplicity of transport blocks 41 connected to one another.

The transport block 41 has a fitting projection 42 projecting forward from its front portion and a fitting cavity 43 formed in its rear portion and opened rearward. The projection 42 of the transport block 41 in the rear is fitted in the cavity 43 in the preceding block 41, and a connecting pin 44 extends through the projection 42 and the cavity 43. The connecting pin 44 has opposite ends projecting laterally from the block and each carrying a support roller 45 thereon. The support rollers 45 are fitted in a pair of guide grooves 47 formed as opposed to each other in a conveyor frame 46.

The holder 34 comprises a flat bottom plate 51 fixed to the upper surface of the transport block 41 and a side plate 52 extending upright from the upper surface of the plate 51.

The bottom plate 51 and the side plate 52 have a width equal to the width of the completed container C2. The height of the side plate 52 from the upper surface of the bottom plate 51 is equal to the height of the completed container C2. The distance between the side plates 52 of the two adjacent holders 34 is equal to the front-to-rear thickness of the completed container C2.

Figure 6:
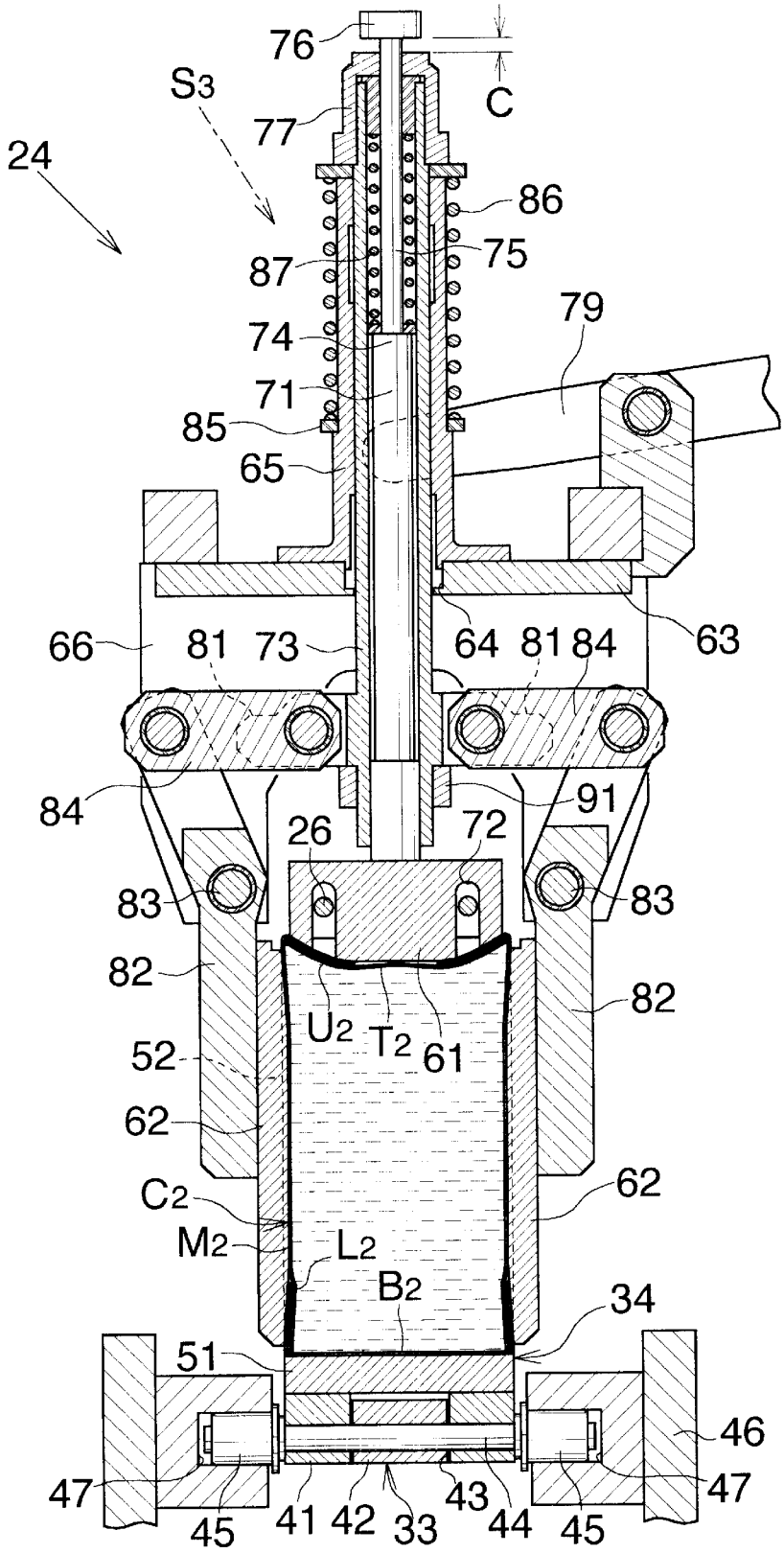
FIG. 6 is a view in cross section of the ear bonding device.
Figure 7:
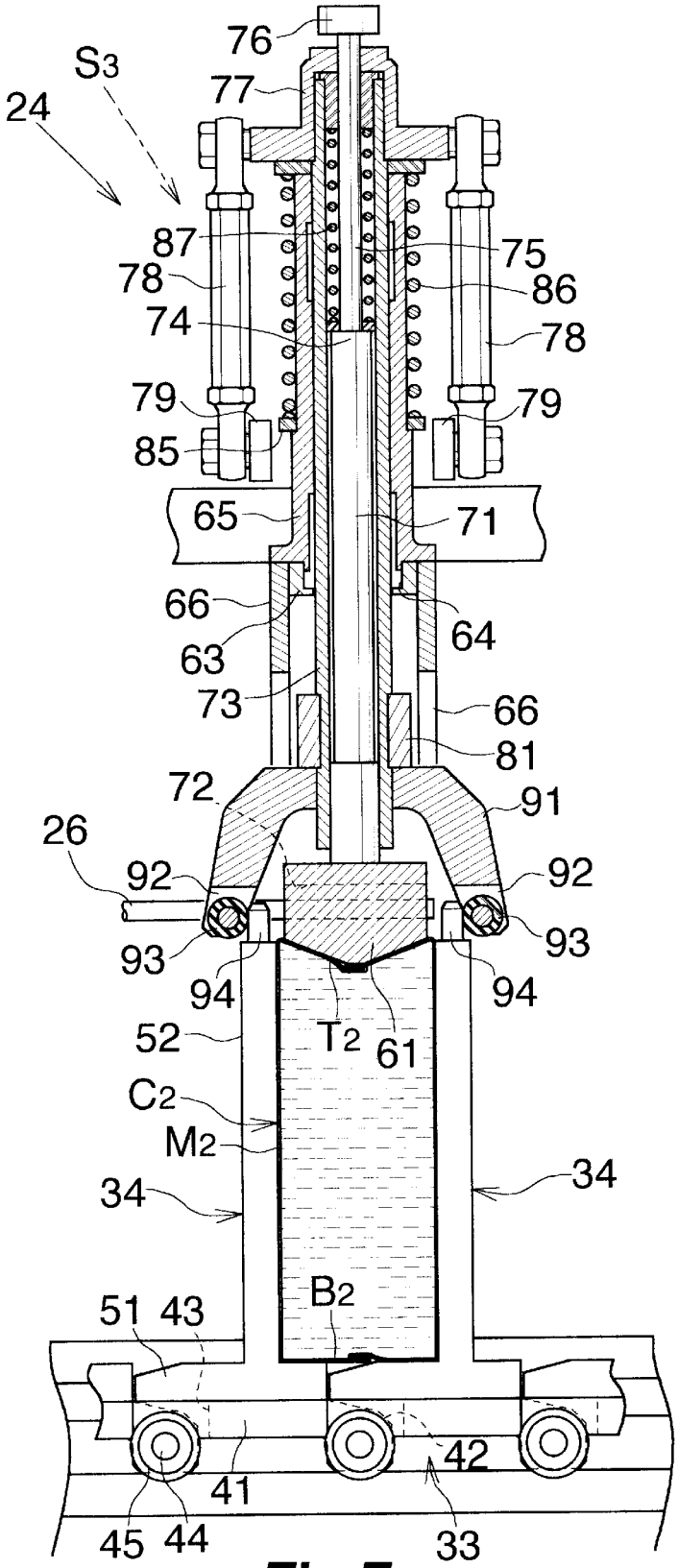
FIG. 7 is a view in longitudinal section of the ear bonding device.

FIGS. 5 to 7 show the ear bonding device 24 in detail.

The ear bonding device 24 comprises an upper ear pressing member 61 disposed above the ear bonding station S3 vertically movably for pressing the upper ears U1 against the upper wall of the container body M1, and a pair of lower ear pressing members 62 arranged at opposite sides of the ear bonding station S3 openably for pressing the lower ears L1 against the respective side walls of the container body M1.

A horizontal support plate 63 is provided above the ear bonding station S3 and has a hole 64 centrally thereof. A vertical guide sleeve 65 is provided upright on the support plate 63 around the upper surface inner periphery thereof defining the hole 64. At the front and rear sides of the hole 64, a pair of mound-shaped opposed brackets 66 extend vertically from the lower surface of the support plate 63.

The upper ear pressing member 61 is in the form of a rectangular parallelepipedal block having a thickness in the vertical direction, and is secured to the lower end of a vertical lift rod 71. An inverted U-shaped escape groove 72 is formed in the lower side of the pressing member 61 for avoiding interference with the folding guide 26. A vertical lift tube 73 is slidably fitted around the lift rod 71. The lift tube 73 is slidably fitted in the guide sleeve 65.

The lift rod 71 has a shoulder portion 74 formed at a portion thereof slightly above the midportion of its height by providing a small-diameter portion 75 above this portion. The small-diameter portion 75 has an upper end projecting upward beyond the lift tube 73. The projecting end is provided with a stopper 76. The lift tube 73 has an upper end projecting upward beyond the guide sleeve 65 and provided with a cap 77. Pivotal arms 79 movable upward or downward are connected, each at one end thereof, to the cap 77 by a pair of connecting rods 78 (FIG. 7). The small-diameter portion 75 extends through the top wall of the cap 77. A clearance C is provided between the stopper 76 and the cap 77 for permitting free movement of the lift rod 71 and the lift tube 73 relative to each other. The lift tube 73 is provided close to its lower end with a pair of ears 81 projecting leftward and rightward in opposite directions.

The two lower ear pressing members 62 are in the form of rectangular plates extending vertically and opposed to each other leftward and rightward, and are secured to the lower ends of a pair of left and right levers 82 extending vertically. The levers 82 are attached by horizontal support rods 83 to the lower ends of the pair of brackets 66 pivotally leftwardly or rightwardly movably. Attached to the upper ends of the levers 82 are a pair of left and right connecting links 84. The links 84 have other ends connected to the respective ears 81.

A large outer compression coil spring 86 fitted around the guide sleeve 65 is provided between a spring retainer 85 on the outer surface of the guide sleeve 65 and a flange at the lower end of the cap 77. A small inner compression coil spring 87 fitted around the small-diameter portion 75 is provided between the shoulder portion 74 and the top wall of the cap 77.

With reference to FIG. 7, a pair of front and rear lock members 91 projecting forward and rearward away from each other in directions orthogonal to the ears 81 and extending forwardly and rearwardly downward obliquely are secured to the lift tube 73 close to its lower end. Each of the lock members 91 has at its lower end a bifurcated portion 92 carrying a vertical roller 93.

On the other hand, a vertical engaging pin 94 is provided upright on the lengthwise midportion of top of the holder 34.

Immediately before the uncompleted container C1 is brought to the ear bonding station S3, the portions to be bonded of the container body M1 and upper and lower ears U1, L1 are heated by the heater 23.

When the container C1 is transported to the ear bonding station S3, the pivotal arms 79 are lowered by unillustrated means, whereupon the lift tube 73 is lowered along with the lift rod 71. The upper ear pressing member 61 descending with the lift rod 71 compresses the inner compression spring 87, thereby pressing the upper ears U1 against the top wall of the container C1 to bond the upper ear U1 to the container upper wall under pressure. When the pressure increases to a predetermined value, the lift rod 71 does not descend further but the lift tube 73 only descends thereafter. Upon the descent of the lift tube 73, the connecting links 84 move the upper ends of the levers 82 away from each other to move the two lower ear pressing members 62 toward each other. Consequently, the lower ears L1 are bonded to the respective side walls of the container body M1 by the pressing members 62.

On the other hand, when the lift tube 73 is lowered to a position a short distance above its lower limit position, the lock members 91 cause the rollers 93 to hold adjacent engaging pins 94 from front and rear sides, whereby the side plates 52 of the adjacent holders 34 are restrained from acting to move the upper ends thereof away from each other.

If the pressure of the upper ear pressing member 61 and the lower ear pressing members 62 is exerted on the container body M1 without restraining the adjacent holders 34, the adjacent transport blocks 41 flex at an obtuse angle with each other by an amount corresponding to the play of components of the chain 33, e.g., the clearance in the guide groove 47 around the support roller 45. This results in the likelihood that the holders 34 will be so flexed as to move the upper ends of the side plates 52 away from each other. Proper pressure then fails to act on the required portions of the container C1 to entail the likelihood of a faulty seal occurring. However, if the holders 34 are so locked by the rock members 91 as described above, this likelihood is avoidable.

Figure 2:
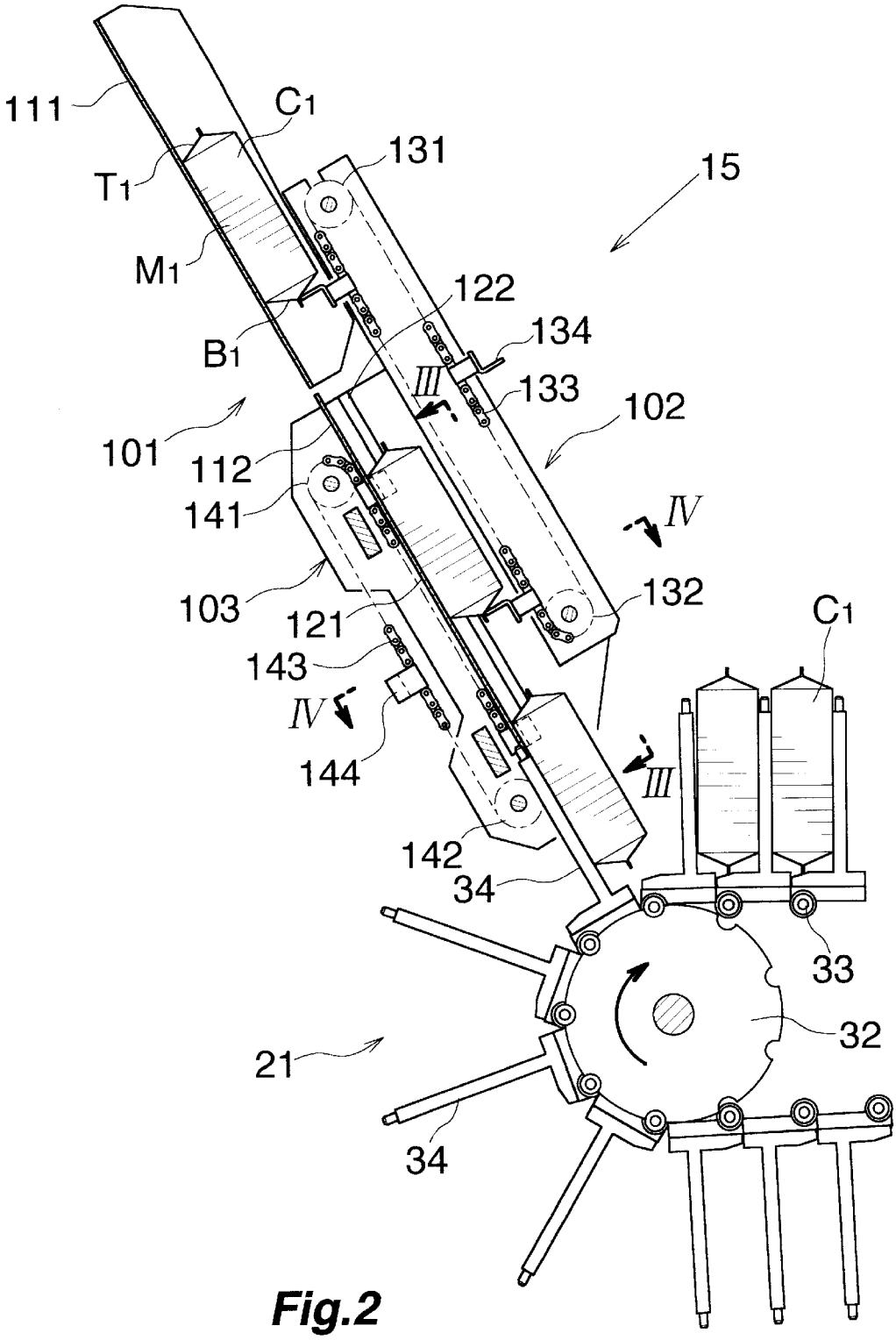
FIG. 2 is a side elevation of the container feeder.
Figure 3:
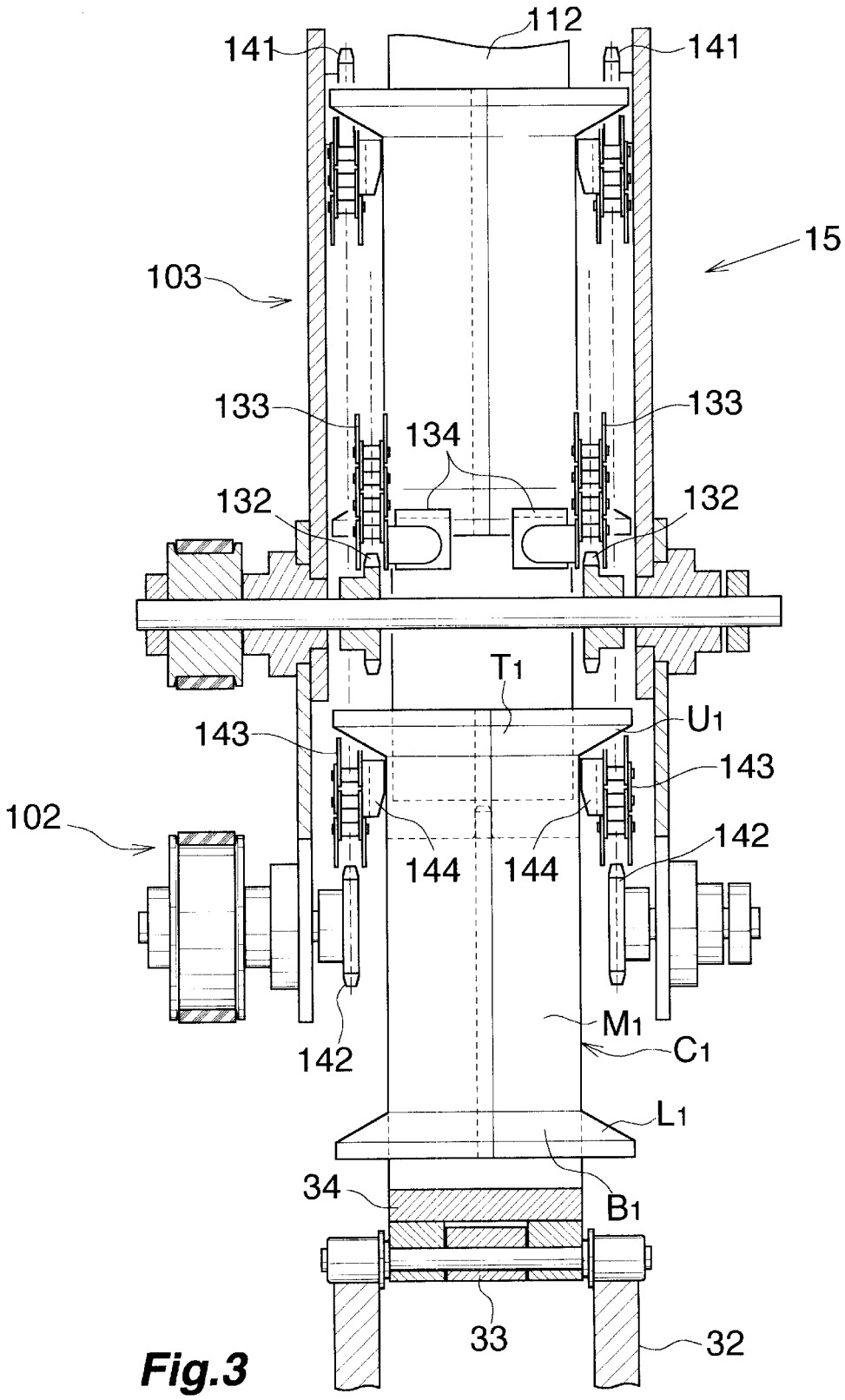
FIG. 3 is a view in longitudinal section taken along the line III—III in FIG. 2.
Figure 4:
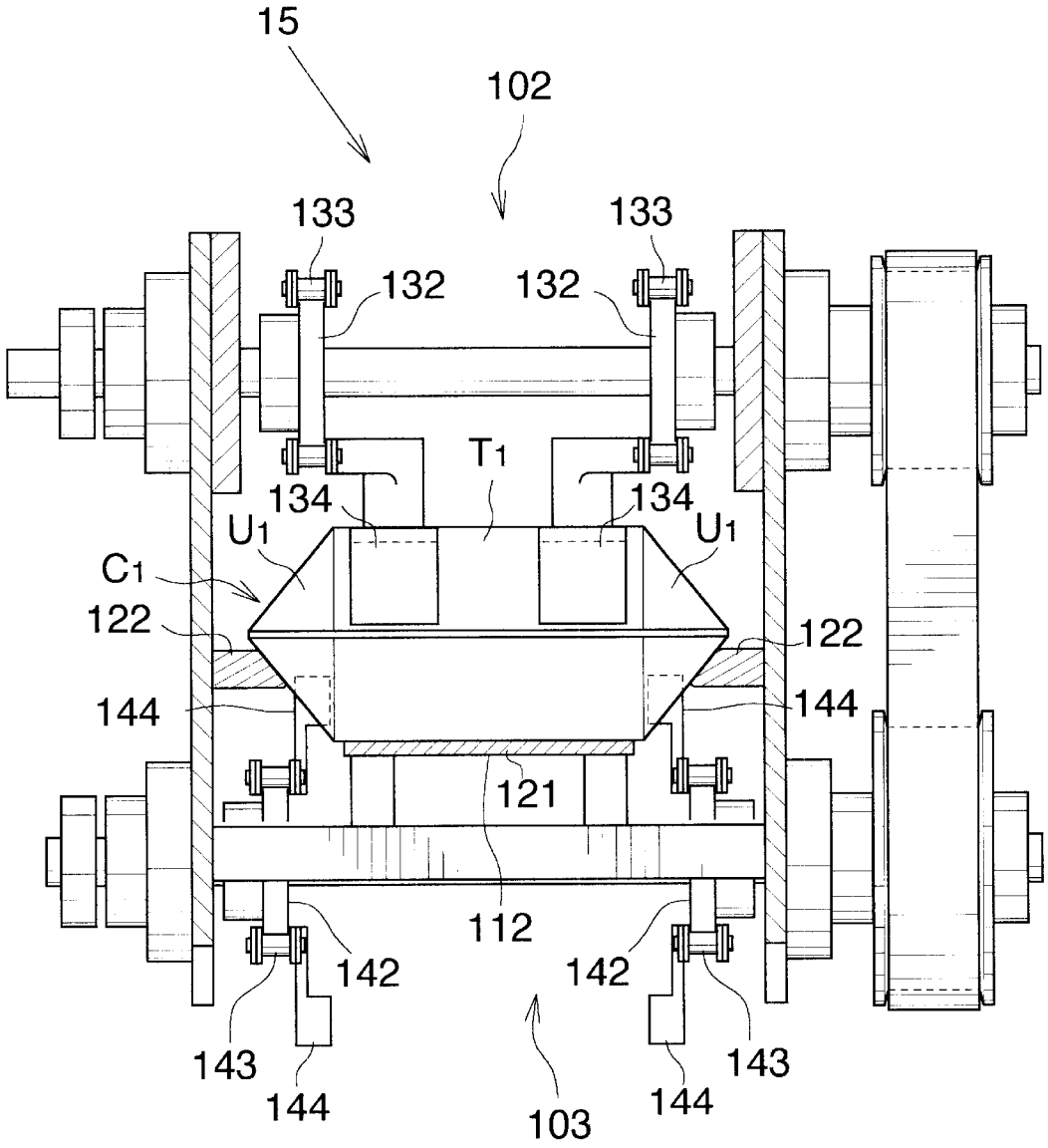
FIG. 4 is a view in cross section taken along the line IV—IV in FIG. 2.

FIGS. 2 to 4 show the container feeder 15 in detail.

The container feeder 15 comprises a slanting supply chute 101 extending from a position below the uncompleted container forming device 13 to the starting end of transport path of the forming conveyor 21, and an upper supply conveyor 102 and a lower supply conveyor 103 arranged respectively on the upper and lower sides of the supply chute 101.

The supply chute 101 comprises an upper chute portion 111 and a lower chute portion 112. The upper chute portion 111 is in the form of a trough as generally known well.

As shown in detail in FIG. 4, the lower chute portion 112 comprises a slide plate 121 for guiding the container body M1 as received thereon, and a pair of guide rails 122 extending in parallel to each other for guiding the ears U1, L1 as received thereon.

FIG. 2 shows one holder 34 as halted at the feed station S0 at the starting end of transport path of the forming conveyor 21. The holder 34 is in the course of travel around the driven sprocket 32, and the upper end of the side plate 52 of the holder is joined to the lower end of the slide plate 121 of the lower chute portion 112.

The upper supply conveyor 102 comprises a pair of left and right upper driven sprockets 131 arranged above the lengthwise midportion of the upper chute portion 111, a pair of left and right upper drive sprockets 132 arranged above a lengthwise intermediate portion of the lower chute portion 112, a pair of left and right upper endless chains 133 each reeved around the sprockets 131, 132 at the same left or right side, and a plurality of upper receiving members 134 attached to the chains 133 at a predetermined spacing.

The upper supply conveyor 102 is so disposed that its chains 133 are driven to move counterclockwise in FIG. 2 and to cause the upper receiving members 134 traveling along the lower path of movement of the chains to advance into the path of transport of the chute.

Two upper receiving members 134 attached respectively to the left and right chains 133 in the same phase are paired, and the pair of upper receiving members 134 is spaced apart by a distance smaller than the width of the container body M1. Accordingly, the container C1 falling along the chute 101 has the lower end of its bottom portion B1 received by the pair of upper receiving members 134.

The lower supply conveyor 103 comprises a pair of left and right lower driven sprockets 141 arranged slightly below the upper end of the lower chute portion 112, lower drive sprockets 142 arranged below the lower end of the lower chute portion 112 at opposite sides of the path of movement of the conveyor holder side plate 52, a pair of left and right lower endless chains 143 each reeved around the sprockets 141, 142 at the same left or right side, and a plurality of lower receiving members 144 attached to the chains 143 at a predetermined spacing.

The lower supply conveyor 103 is so disposed that its chains 143 are driven to move clockwise in FIG. 2 in opposite direction to the chains of the upper supply conveyor 102 and to cause the lower receiving members 144 traveling along the upper path of movement of the chains to advance into the path of transport of the chute.

Like the upper receiving members 134, two lower receiving members 144 attached respectively to the left and right chains 143 in the same phase are paired, but the pair of lower receiving members 144 are spaced apart by a distance larger than the width of the container body M1 but smaller than the distance between the outer ends of the ears U1, L1. Accordingly, the container C1 falling along the chute 101 has the lower ends of its upper ears received by the pair of lower receiving members 144.

The two supply conveyors 102, 103 are so driven that the upper receiving members 134 move at a higher speed than the lower receiving members 144.

The uncompleted container C1 is discharged from the uncompleted container forming device 13 by falling. The discharged uncompleted container C1 is received by the upper chute portion 111 and received by a pair of upper receiving members 134 while falling along the upper chute portion 111 under gravity. The container C1 is thereafter transported as received by the upper receiving members 134. Soon after the upper receiving members 134 receiving the uncompleted container C1 have moved past the location of the lower driven sprockets 141, a pair of lower receiving members 144 advance to below the upper ears U1 of the container. Since the upper receiving members 134 move faster than the lower receiving members 144, the lower receiving members 144 come into contact with the upper ears U1 of the container received by the upper receiving members 134, and the upper receiving members 134 leave the container, whereby the upper receiving members 134 are replaced by the lower receiving members 144 for receiving the container C1. The uncompleted container C1 is therafter transported as received by the lower receiving members 144 along the lower chute portion 112. Upon the lower receiving members 144 reaching the location of the lower drive sprockets 142, the bottom portion of the container C1 as received by the lower receiving members 144 is seated on the bottom plate 51 of the holder 34 waiting at the location. In this way, the uncompleted container C1 is completely delivered from the supply chute 101 to the forming conveyor 21.

What is claimed is:

1. A container feeder for feeding pillowlike uncompleted containers each having a container body and upper and lower ears projecting laterally from upper and lower ends of the container body to a conveyor of a container forming device for forming the uncompleted container into a rectangular parallelepipedal completed container, the container feeder comprising:

a slanting chute having a lower end positioned at a starting end of a conveyor transport path, a first receiving member so disposed as to be movable upward or downward along a chute transport path, the first receiving member being movable into the chute transport path when moving downward to receive the lower end of the container body of the container falling along the chute under gravity, and a second receiving member so disposed as to be movable upward or downward along the chute transport path, the second receiving member being movable into the chute transport path when moving downward to receive the upper ears of the container received by the first receiving member.

2. A container feeder according to claim 1 wherein a path of upward or downward movement of the second receiving member has a lower end joined to the starting end of the conveyor transport path.

3. A container feeder according to claim 2 wherein the speed of downward movement of the first receiving member is higher than the speed of downward movement of the second receiving member.

4. A container feeder according to any one of claims 1 to 3 wherein the first receiving member is attached to a first endless chain having a lower-side travel path positioned close to the chute transport path along the upper side thereof, and the second receiving member is attached to a second endless chain having an upper-side travel path positioned close to the chute transport path along the lower side thereof, the second endless chain comprising a pair of chain members extending in parallel as spaced apart from each other by a predetermined distance and each having the second receiving member attached thereto, the chain members having lower ends positioned at opposite sides of the starting end of the conveyor transport path.

5. A container feeder according to any one of claims 1 to 3 wherein the conveyor has holders, each holder comprising a bottom plate extending in parallel to the conveyor transport path, and a side plate projecting upward from the bottom plate and extending orthogonal to the conveyor transport path, the side plate of the holder as halted at the starting end of the conveyor transport path having an upper end joined to the lower end of the chute to deliver the container from the chute to the holder in this state.

6. A container feeder according to claim 4 wherein the conveyor has holders, each holder comprising a bottom plate extending in parallel to the conveyor transport path, and a side plate projecting upward from the bottom plate and extending orthogonal to the conveyor transport path, the side plate of the holder as halted at the starting end of the conveyor transport path having an upper end joined to the lower end of the chute to deliver the container from the chute to the holder in this state.

* * * * *